United States Patent [19]

Jones

[11] Patent Number: 4,557,668

[45] Date of Patent: Dec. 10, 1985

[54] DOWN HOLE PUMP HAVING A GAS RELEASE VALVE

[76] Inventor: William A. Jones, P.O. Box 621, Lotus, Calif. 95651

[21] Appl. No.: 690,033

[22] Filed: Jan. 9, 1985

[51] Int. Cl.[4] ..... F04B 3/00; F04B 21/06

[52] U.S. Cl. ..... 417/259; 417/435; 417/444

[58] Field of Search ..... 417/444, 435, 554, 259

[56] References Cited

U.S. PATENT DOCUMENTS

| | | | |
|---|---|---|---|
| 969,127 | 8/1910 | Arnold | 417/443 |
| 1,066,798 | 7/1913 | Conrader | 417/259 |
| 2,344,786 | 3/1944 | Patterson et al. | 417/443 |
| 2,723,625 | 11/1955 | Nichols | 417/259 |
| 3,074,352 | 1/1963 | Vincent | 417/259 |
| 3,941,516 | 3/1976 | Soberg | 417/259 |
| 4,219,311 | 8/1980 | Simon | 417/454 |

*Primary Examiner*—William L. Freeh

*Attorney, Agent, or Firm*—Mark C. Jacobs

[57] ABSTRACT

A downhole pump having a gas release valve which valve can be easily applied to the fixed barrel of a conventional downhole traveling plunger pump by merely lengthening such barrel. A trip on the pull rod attached to the plunger lifts off a valve element of the barrel valve seat to release any gas or foamy oil otherwise trapped between the lower standing valve and the traveling valve of the plunger. Such release takes place on each stroke of the pump. The invention is useful for obtaining oil under subterranean formation conditions that do not normally permit such recovery efficiently due to gas locks and can be either provided in a downhole pump or added to a conventional traveling plunger preexisting pump.

10 Claims, 4 Drawing Figures

DOWN HOLE PUMP HAVING A GAS RELEASE VALVE

BACKGROUND OF THE INVENTION

1. Field of the Invention

The invention relates to apparatus for pumping oil wells, and, more particularly, to gas release apparatus for oil well pumps.

2. Description of the Prior Art

Production of oil from oil wells is usually accompanied by some of the gas in the well flowing through the down hole pumps. If this gas is allowed to accumulate in the barrel of the downhole pump, a condition known as "gas lock" occurs. Such a condition occurs when foamy oil or surges of subterranean gases become trapped between the plunger of the traveling-plunger-type downhole pump and the standing valve at the bottom of the pump. In such a condition, little if any fluid can be pumped out of the well. The downhole pump may simply be compressing and expanding the gas that is locked in the barrel. The forces of the huydrostatic or column of fluid, when the column is generally several feet in height, bearing on the plunger, causes the trapped gases to compress and decompress. This keeps the plunger and the standing valve closed preventing the pump from working.

The nature of valves used in existing downhole oil well pumps lends itself to the creation of gas locks. Normally, the pressure differential across the traveling ball valve of the plunger during the downward stroke opens the valve and allows the fluid in the pump barrel to escape into the discharge tubing. If the fluid in the pump barrel is mostly gas, the traveling ball valve may not open. Thus, as heretofore stated, the pump will not be operating properly and little if any fluid will be flowing into the discharge tubing.

In the past, it has been suggested to remedy such condition by preventing gas from reaching the pump. This was accomplished by using an annulus below the pump inlet. However, in order to implement such a remedy, accurate data is required about the generally unknown formation characteristics. Furthermore, the fluid reservoir characteristics of such formations change with time, requiring constant adjustments to the pump installations. Therefore, the annulus method of preventing gas from reaching the pump is neither practical or effective.

In U.S. Pat. No. 1,676,186 to Hawkins, a valve control for plunger-type pumps is disclosed. However, this arrangement depends on precise spacing of the internal parts which is quite impractical. In U.S. Pat. No. 1,067,312 to Conrader, a pump is disclosed for pumping gas. Again, spacing is quite critical and no provision is made to prevent gas lock. Also, such apparatus cannot positively pump on each cycle. In U.S. Pat. No. 1,793,572 to Von Linde, a tubing check valve for a pump is disclosed. Such apparatus is quite expensive and no positive way of unseating the check valve is disclosed. Such prior art devices are relatively impractical to implement and quite costly. In my copending U.S. application No. 688,029 filed concurrently herewith, I disclose a gas release probe for traveling-barrel type pumps for curing gas lock therein. However, traveling-plunger-type oil wells cannot use a gas release probe for practical reasons.

There is thus a need for eliminating gas lock in traveling plunger-type oil well pumps in an efficient and inexpensive manner.

SUMMARY OF THE INVENTION

It is an object of this invention to provide an improved traveling plunger type oil well pump having a hydrostatic valve for eliminating gas lock.

It is a further object of this invention to provide apparatus for eliminating gas lock in traveling barrel-type oil well pumps by eliminating pressure differential across the valves of the pump.

It is another object of this invention to carry out the foregoing objects by either incorporating a hydrostatic in a preexisting traveling plunger-type downhole pump or providing a downhole pump having such valve installed therein.

These and other objects are preferably accomplished by providing a hydrostatic valve in the traveling barrel of a plunger-type downhole pump by merely lengthening the barrel of such pump. The trip rod of the probe lifts the valve element off its seat in the traveling valve to release any gas or foamy oil otherwise trapped between the lower standing valve and the upper traveling valve of the pump. Such release takes place on each stroke of the pump. The invention is useful for obtaining oil under subterranean formation conditions that do not normally permit such recovery efficiently due to gas locks and can be either provided in a downhole pump or added to a preexisting pump.

DESCRIPTION OF THE PREFERRED EMBODIMENT

Figure 1:
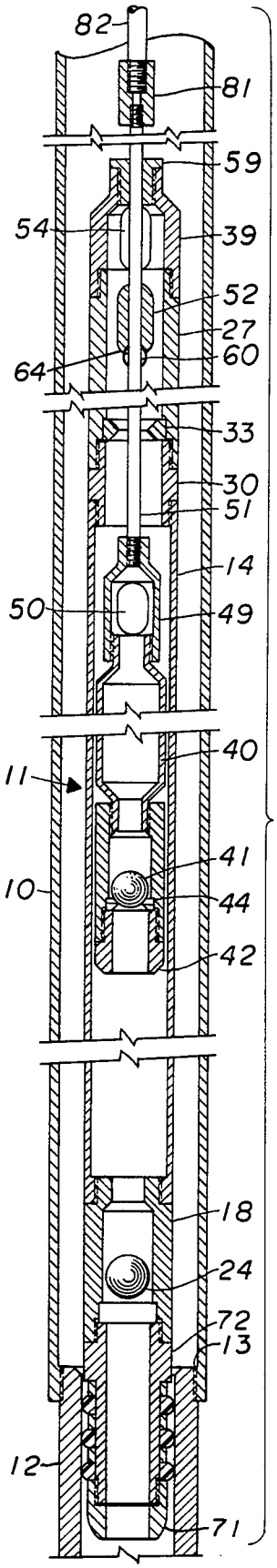
FIG. 1 is a vertical cross-sectional view of a downhold pump shown in the upstroke position incorporating a gas release in accordance with the teachings of the invention.

Referring now to FIG. 1 of the drawing, a tubing 10 is shown extending downwardly from a wellhead at the surface to a subterranean formation from which it is desired to recover oil. A downhole pump 11 of the traveling plunger type is disposed interiorly of tubing 10 and is seated in a conventional seating nipple 12 which may be threaded at threads 13 to the lower end of tubing 10. Pump 11 includes a standing assembly 14' and a traveling assembly 15'. These assemblies are shown in assembled view forming pump 11 in FIG. 1 and in exploded views, removed from the completed assembled structure of FIG. 1, in FIGS. 2 and 3.

Figure 2:
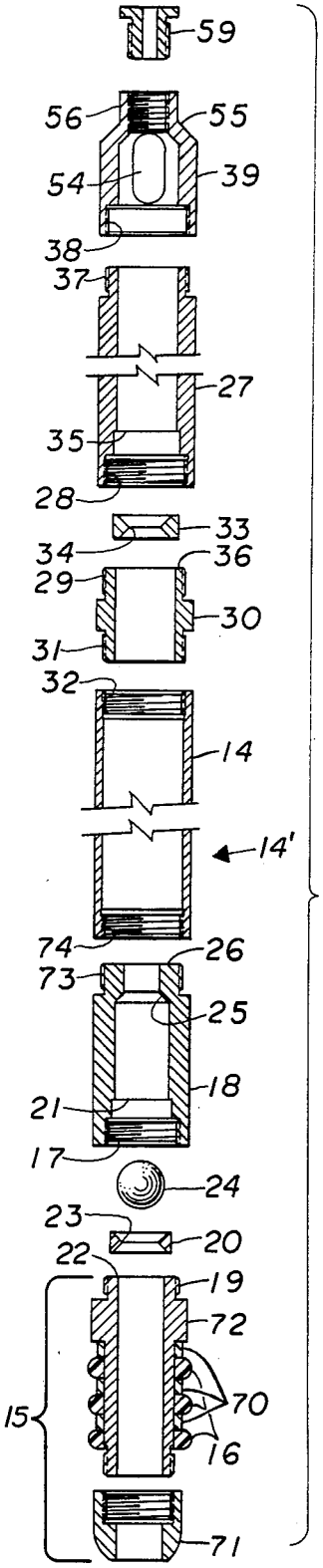
FIGS. 2 and 3 are exploded views of portions of the apparatus of FIG. 1.

Thus, as seen in FIG. 2 and FIG. 1, the standing assembly 14' includes a pump barrel 14 terminating at its lower end in a seating assembly 15 extending through seating nipple 12. Assembly 15 is of conventional structure and includes one or more sealing cups 16 encircling assembly 15 spacing it from the interior wall of nipple 12 as shown. Spacing rings 70 are provided between cups 16 and above the uppermost cup 16. A compression nut 71 is threaded to the lower end of main housing 72 of assembly 15.

As seen in FIG. 2, assembly 15 may be threaded to the lower threaded end 17 of a standing cage 18 by mating threads 19 on assembly 15. A valve seat 20 may be mounted in the lower end 17 of cage 18 abutting against shoulder 21 prior to threading of assembly 15 to cage 18. In this manner, end 22 of assembly 15 will abut and bear against one side of valve seat 20 wedging it against shoulder 21 thus retaining seat 20 in fixed position within cage 18. Valve seat 20 includes a central opening 23 of a diameter less than a ball element 24, or similar element, freely movable within lower standing cage 18. Cage 18 terminates at its upper end in a reduced neck portion 25 for limiting the upward movement of ball element 24. That is, the opening 26 through neck portion 25 is less than the diameter of ball element 24.

Neck portion 25 is in turn secured to the lower end of barrel 14 in any suitable manner, such as mating threads 73 on cage 18 and threads 74 on the lower end of barrel 14. As seen in FIG. 1, barrel 14 extends upwardly through tubing 10 and includes a variable length extension portion 27 (see also FIG. 2) interconnected to barrel 14 by an adapter 30. Barrel portion 27 is coupled via threaded end 28 to mating threaded end 29 of adapter 30 also threaded via threaded end 31 to the upper threaded end 32 of the barrel 14. A sleeve seat 33, having a central opening 34, is fixedly secured between barrel extension portion 27 and adapter 30 by wedging against shoulder 35 and end 36 of adapter 30 as heretofore discussed with respect to seat 20. Barrel extension portion 27 terminates at its upper end in a threaded end 37 for mating engagement with a threaded end 38 on an upper cage 39.

Figure 3:
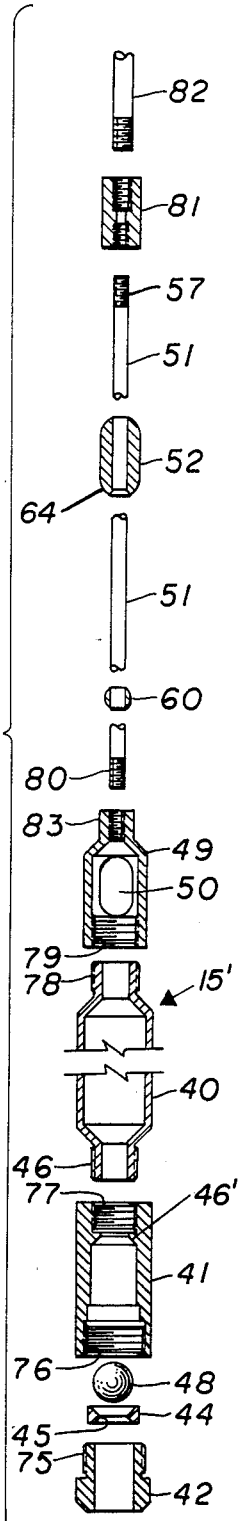

Referring now to FIG. 3, the traveling assembly 15' includes a traveling variable length plunger 40 mounted internally of barrel 14 and reciprocal therein (FIG.1). Plunger 40 terminates at its lower end in a closed traveling cage 41. A seat retaining bushing 42 is threaded via threads 75 to mating threads 76 at the lower end of cage 41. A ball valve seat 44, having a central opening 45 therethrough, is mounted in the manner heretofore described with respect to seats 20, 33. Of course, seat 44 may be fixed in position internally of cage 41 in any suitable manner. A reduced diameter threaded neck portion 46 is provided at the lower end of plunger 40 and cage 41 is threaded thereto via threads 77. A ball element 48 is freely movable within cage 41 and is of a diameter greater than the diameter of the opening 45 in valve seat 44 and the opening through neck portion 46, designated 46'.

Plunger 40 terminates at the top in a reduced diameter threaded neck portion 78 threaded via threads 79 to an open cage 49 having one or more openings 50 therethrough. A variable length plunger pull rod 51 extends from cage 49, threaded via threads 80 to a threaded reduced diameter neck portion 83 of cage 49, upwardly within barrel 14 through opening 34 in seat 33 through a sleeve 52 (FIG. 1) encircling rod 51 within barrel 14 above seat 33.

Upper cage 39 (see also FIG. 2) is a rod guide bushing for rod 51 and has one or more openings 54 therethrough with an upper reduced diameter neck portion 55 having an elongated threaded neck 56 receiving threaded end 57 of pull rod 51 therethrough. A wear bushing, such as a Teflon bushing 59, (FIG. 2) may be threaded into neck 56 having rod end 57 extending therethrough. A sleeve trip 60 is provided on rod 51 for reasons to be discussed. Rod end 57 may be threaded to an adapter 81 (FIG. 3) which adapter 81 is in turn threaded to the sucker rod 82 of the well assembly.

Any suitable materials may be used, such as stainless steel, and the invention disclosed herein may be provided in a new improved pump incorporating the invention or a conventional traveling plunger type oil well pump may be so modified. The seating assembly 15 may include male threads screwing into female threads of cage 18 as heretofore described. Ball element 24 moves interiorly of cage 18 and the upper end thereof may have a male screw thread adapted to screw into the lower end of pump barrel 14. Barrel 14 may have female threads at both ends and adapter 30 may have male threads at both ends 29, 31 adapted to screw the same to barrel 14, at one end, and to barrel extension 27 at the other end (FIG. 2), which extension may vary in length. Extension 27 in turn may have female threads at end 28 and male threads 37 at the upper end for connection to female threads on upper open cage 39. The upper end of neck 56 may have female threads for receiving male threads on bushing 59. Pull rod 51 may be ground and polished and reciprocates in a hollow bore in neck portion 55. Rod 51 may be provided with a male thread at top for connection to the sucker rob to pull rod spacer 81.

Sleeve 52 is preferably bored and honed to a predetermined interior diameter reted to the diameter of pull rod 51, such as to a tolerance of +0.0005 to 0.001 inches, and fits on rod 51 above seat 33 and slides freely on rod 51. As seen in FIG. 1, the lower or bottom end 64 is configured to rest in the opening 34 in seat 33 and seal therein. End 64 is thus preferably ground to a radius equal to the radius of opening 34.

Sleeve trip 60 is fixed to rod 51 below seat 33 and has a convex radius equal to the concave radius at the bottom of sleeve 52. Trip 60 has an overall diameter on rod 51 less than the width of the opening 34 in seat 33 so that it can pass therethough. Thus, trip 60 is adapted to unseat sleeve 52 out of opening 34 in seat 33 during the upstroke of the pump 11 as will be discussed.

Plunger 40 also varies in length, preferably with male threads at each end for connection to female threads on cage 41 and to cage 49.

Figure 4:
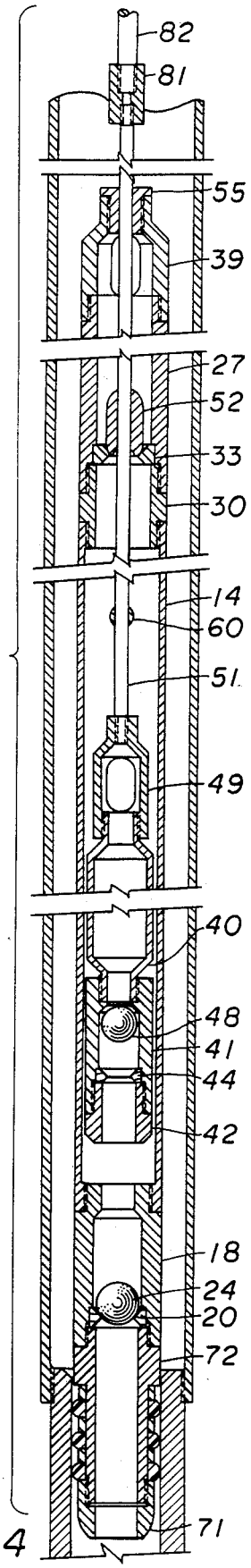
FIG. 4 is a vertical view, similar to FIG. 1, showing the pump in its downstroke position.

In operation, pump 11 can pump either gas or fluid in a positive manner at each cycle of the pump regardless of pressure differential across the valves. The pump 11 is lowered and seated in the seating nipple 12. The plunger 40 is in the position shown in FIG. 4. On the upstroke, or the position shown in FIG. 1, the ball valve 48 seats in opening 45 in seat 44 and thus the traveling valve closes and the lower or standing valve (element 24 and seat 20) opens to allow oil or fluid to enter into that space previously occupied by the plunger 40. This constitutes one-half of the cycle.

On the downstroke, or return to the FIG. 4 position, the lower or standing valve 20, 24 closes and the upper or traveling valve 44, 48 opens allowing fluid to enter through valve 44, 48, the hollow closed cages 18, 41, the hollow plunger 40, then out opening 50 and through the cage up into pump barrel 14 above the plunger, but below seat 33, thus completing the cycle.

Thus, the rod 51 and sleeve 52 arrangement supports the pressure bearing on the valve 44, 48 and relieves that force on valve 44, 48 thereby preventing trapped gas from being compressed in the space between valve 44, 48 and valve 24, 20. The released gases move into the space above plunger 40 but below standing seat 33. Thus, there takes place a transfer of gas from the lower chamber between valve 44, 48 and valve 24, 20 to the upper chamber above plunger 40 and below seat 33.

The gas may be trapped in this upper chamber again transferring valve 33, 52 to an upper standing valve having the same hydrostatic forces bearing on it.

However, the mechanical trip 60 unseats sleeve 52 from its seat in opening 34 prior to the apex of the upstroke allowing any trapped gases below seat 33 to escape through opening 34, through upper barrel portion 39, out openings 54 and into the tubing string 10 and thus out of the wellhead.

Thus, I have disclosed herein an improved pump for pumping either oil or fluid at every cycle of the pump. Even in an extended pumping operation, where gas only is being pumped, plunger 40 is lubricated when trip 60 allows sleeve 52 to reseat on the downstroke. The flow of oil from oil sand formations is accomplished at each cycle whether gas or oil, or a combination thereof, is being pumped. Since it is estimated that close to 100% of all wells have some gas, and 70 to 80% are affected by production loss, energy waste and pump inefficiency, increased oil production may be carried out using my invention in an economical and efficient manner.

Valve 33, 52 is thus closed during downstroke thereby supporting the weight of fluid in tubing 10 causing a reduction of the differential pressure across traveling valve 44, 48. With a diminished pressure holding the traveling valve 44, 48 closed, it will be more likely that compression of the fluid in the pump barrel 14 will generate enough force to open it allowing transfer of the fluid from the pump 11 to the tubing 10. The sleeve valve 33, 52 is mounted in a hollow cylinder or extension portion 27 through which slides the rod 51 that transmits motion of the plunger 40. The rod 51 and the valve 33, 52 are machined or honed to a close tolerance so that there is essentially no leakage of fluid through the sleeve 52. At the end of the upstroke, the sleeve valve 52, 33 is forced open by trip 60, which may be merely an enlargement of the rod diameter. Trip 60 lifts the valve sleeve 52 off the seat 33 if it has not already been lifted off by the fluid above the plunger 40. The presence of this extra "standing valve" (valve 33, 52) insures that fluid transfer between pump 11 and the tubing 10 takes place regardless of the amount of gas present in the pump 11. The position of the valve trip 60 is critical if the efficiency of the pump 11 is not to be reduced due to interference with the normal operation of the standard valves of the pump 11. The presence of sleeve 52 in the seat 33 may retard the closing of the traveling valve 44, 48 since its operation is controlled by the application of the fluid load to the top of the ball 48.

The invention herein ensures opening and closing of the pump's valves regardless of the composition of the fluids present in the pump barrel 14.

The invention alleviates the problem of "gas lock" which may be present in large numbers of pumping oil wells producing from reservoirs in the last stages of depletion. Conventional downhole sucker rod pumps utilize ball and seat valves which rely on the pressure differential across the valve to determine the opening and closing cycle. The invention herein provides simple solution to the problem of gas lock in traveling plunger type pumps. The invention disclosed herein will pump either gas or fluid at every complete cycle of the pump. The invention will assist in the flow of oil through the oil sand formation to the production zone due to the pump removing either gas or oil at every cycle.

I claim:

1. In a downhole well pump having a fixed lower standing valve having an opening leading into a first open end thereof, a first valve seat in said valve having an opening normally closed by a valve element freely movable in said valve and of a diameter sufficient to normally close off the opening in said valve seat, said valve having a second open end with a reduced neck opening of a diameter less than the diameter of said valve element, said seat being disposed between said first and second open ends, a barrel fixed to said valve extending upwardly therefrom and in fluid communication with the interior of said valve, a traveling plunger disposed in said barrel and movable with respect thereto, said traveling plunger having one end coupled to a pull rod, a second valve having an opening therein fixed to the other end of said plunger in fluid communication with the interior of said barrel, a second valve seat having an opening therein in said second valve and a second valve element of a diameter greater than said second valve seat opening in said second valve above said second valve opening, a throughbore receiving said pull rod therethrough and a cage having an opening therein at the upper end of said barrel communicating with the outside of said barrel, the upper end of said cage having a reduced neck portion, the improvement which comprises:

gas release means within said barrel above said second valve and below said cage comprising a third valve seat mounted in said barrel having an opening therein, a third valve element slidably mounted on said pull rod above said third valve seat and below said cage having a diameter greater than the width of said valve seat opening and spaced from the walls of said barrel, and a trip fixedly mounted on said pull rod below said third valve seat of a diameter less than the diameter said said third valve seat opening and spaced from the walls of said barrel whereby said trip is adapted to pass upwardly through the opening in said third valve seat and lift said third valve element off of said third valve seat.

2. In the pump of claim 1 wherein the portion of said pull rod adjacent said cage and said third valve seat is a ground and polished metal rod.

3. In the pump of claim 1 wherein said third valve element is an elongated sleeve and tapered at the bottom thereof, said tapered bottom, adjacent said third valve seat opening, having a convex radius generally equal to the radius of said third valve seat opening.

4. In the pump of claim 3 wherein said third valve element is bored and honed to an interior diameter generally related to the outer diameter of said pull rod with a tolerance of between about +0.0005 to 0.001 inches.

5. In the pump of claim 3 wherein said trip has a convex radius generally equal to the concave radius of said tapered bottom.

6. A downhole pump comprising:

an elongated barrel fixed to a first standing valve, a traveling plunger movable in said barrel, said plunger having a valve at its lower end and a valve element and valve seat therein;

said barrel having a cage within an opening therein above said plunger;

a pull rod connected to one end of said plunger and extending upwardly through said cage; and a valve seat mounted in said barrel between said cage and said plunger, said last mentioned valve seat having an opening therein with said pull rod extending through said opening, a valve element slidably mounted on said pull rod above said last mentioned valve seat having a diameter greater than the opening in said last mentioned valve seat opening and spaced from the walls of said barrel, and a trip fixedly mounted on said pull rod below said last mentioned valve seat of a diameter less than the diameter of said last mentioned valve seat opening and spaced from the walls of said barrel whereby said trip is adapted to pass upwardly through the opening in said last mentioned valve seat and lift said last mentioned valve element off of said last mentioned valve seat.

7. In the pump of claim 6 wherein the portion of said pull rod adjacent said cage and said last mentioned valve seat is a ground and polished metal rod.

8. In the pump of claim 6 wherein said last mentioned valve element is an elongated sleeve tapered at the bottom thereof, said tapered bottom, adjacent said last mentioned valve seat opening, having a convex radius generally equal to the radius of said last mentioned valve seat opening.

9. In the pump of claim 8 wherein said last mentioned valve element is bored and honed to an interior diameter generally related to the outer diameter of said pull rod with a tolerance of between about +0.0005 to 0.001 inches.

10. In the pump of claim 8 wherein said trip has a convex radius generally equal to the concave radius of said tapered bottom.

* * * * *